United States Patent [19]

Ahn

[11] Patent Number: 5,004,360

[45] Date of Patent: Apr. 2, 1991

[54] CARRIAGE DEVICE FOR AN ELECTRONIC TYPEWERITER USING A TWO-ROW DAISY WHEEL

[75] Inventor: Chang S. Ahn, Kyungki, Rep. of Korea

[73] Assignee: Goldstar Co., Ltd., Seoul, Rep. of Korea

[21] Appl. No.: 359,840

[22] Filed: May 31, 1989

[30] Foreign Application Priority Data

May 31, 1988 [KR] Rep. of Korea ..... 6630/1988

[51] Int. Cl.[5] ..... B41J 1/24

[52] U.S. Cl. ..... 400/144.2; 400/175

[58] Field of Search ..... 400/144.2, 144.3, 144.4, 400/157.1, 157.2, 157.3, 174, 175, 216.1, 225, 240, 240.4, 697.1

[56] References Cited

U.S. PATENT DOCUMENTS

| | | | |
|---|---|---|---|
| 4,106,611 | 8/1978 | suxzuki et al. | 400/144.2 |
| 4,203,677 | 5/1980 | Hatsell | 400/144.2 X |
| 4,324,497 | 4/1982 | Gabor | 400/144.2 |
| 4,392,756 | 7/1983 | Lee | 400/144.2 |
| 4,457,738 | 7/1984 | Gross et al. | 400/144.2 X |
| 4,462,707 | 7/1984 | Falconieri | 400/175 X |
| 4,507,001 | 3/1985 | Babler | 400/144.2 |
| 4,553,866 | 11/1985 | Demonte et al. | 400/144.2 |
| 4,553,868 | 11/1985 | Crosio | 400/144.2 X |
| 4,586,837 | 5/1986 | Johnson et al. | 400/240.4 X |
| 4,637,744 | 1/1987 | Valle et al. | 400/216.1 X |
| 4,728,208 | 3/1988 | Iwase et al. | 400/216.1 X |
| 4,746,236 | 5/1988 | Shioda | 400/144.2 |
| 4,806,030 | 2/1989 | Quaranti et al. | 400/144.2 |

FOREIGN PATENT DOCUMENTS

| | | | |
|---|---|---|---|
| 0119764 | 9/1984 | European Pat. Off. | 400/144.2 |
| 0195661 | 12/1982 | Japan | 400/175 |

*Primary Examiner*—Edgar S. Burr
*Assistant Examiner*—John S. Hilten
*Attorney, Agent, or Firm*—Birch, Stewart, Kolasch & Birch

[57] ABSTRACT

A carriage for an electronic typewriter using a 2-row daisy wheel includes a slant bracket pivotally connected to a rail disposed on a main frame, a vibrator movable upward and downward to the main frame, a take-up wheel and a supply wheel around which the correction tape is wound, a print ribbon cartridge coupled to an upper surface of the vibrator, a hammering device utilizing a hammer lever, a print wheel elevation and rotation device, a print ribbon carrying device driven by commonly using a drive motor and a cam gear, a correction tape up/down and carrying device and a sensing device detecting the carrying condition of the print ribbon and correction tape by sensing a rotation of the cam gear, thereby a simple construction and a reduction in cost can be achieved.

9 Claims, 11 Drawing Sheets

CARRIAGE DEVICE FOR AN ELECTRONIC TYPEWERITER USING A TWO-ROW DAISY WHEEL

BACKGROUND OF THE INVENTION

The present invention relates to a carriage for an electronic typewriter, and more particularly to a carriage for an electronic typewriter using a 2-row daisy wheel.

In a typewriter using a 2-row daisy wheel (hereinafter, referred to as a print wheel), there are provided a print wheel elevation mechanism which moves a print wheel upwardly and downwardly in order to type a letter element arranged at the upper and lower rows, a rotating mechanism which rotates the selected letter element to a typing position at the upper or lower position, a hammering mechanism which hits the selected letter element so as to be typed, an initial position determining means which retains the print wheel in a reference position (initial typing position), a print ribbon carrying mechanism which carries a print ribbon as much as a share for one letter, and a correction tape carrying mechanism which carries a correction tape for erasing a mistyped word, and such mechanisms are mounted on a carriage which is movable on a pair of rails fixed in parallel with a platen.

A conventional electronic typewriter is constructed in such manner that an up/down lever is operably connected to a crank shaft of an up/down motor and the up/down lever is connected to a universal shaft of a print wheel drive motor so that a print wheel can be moved upwardly and downwardly upon the drive of the up/down motor and the print wheel can be rotated by the driving force of the print wheel drive motor.

In such a conventional typewriter, there has been some disadvantages in that since a universal joint has to be used in order to transmit the driving force of the print wheel drive motor, the construction of the carriage becomes complicated and at the same time the components may be easily broken by the excessive torque applied thereto Furthermore, the use of the up/-down motor resulted in a complicated structure of the carriage, thus giving rise to a cost increase, and there is also a need for a additional structure for retaining an initial typing position because of not being provided the function therefor. Furthermore, in a conventional electronic typewriter, there has also been a disadvantage in that since a hammer of a hammer solenoid is to hit directly a spoke of a print wheel to type, an expensive solenoid only for use in the hammer is required.

Furthermore, in a conventional electronic typewriter, there has been another disadvantage in that a print ribbon mechanism adopts a separate drive motor, so that it is not used in common with a correction tape up/down and carrying mechanism, thereby the whole construction becomes complicated.

Furthermore, in a conventional electronic typewriter, there has been other disadvantages in that since there is not provided an adjusting mechanism for retaining a print wheel in a precise operating position, it is difficult to adjust the operating position of the print wheel when needed.

SUMMARY OF THE INVENTION

It is, therefore, an object of the present invention to provide a carriage for an electronic typewriter which does not implicate the above-mentioned disadvantages encountered in the conventional electronic typewriter.

A further object of the present invention is to provide a carriage for an electronic typewriter which is suitable for performing a function of load and unload of a print wheel, an elevation function of a print wheel, a hammering function, a ribbon carrying function, and a function for up/down and carrying of a correction tape, and has a simplified construction.

Another object of the present invention is to provide a carriage for an electronic typewriter in which a print wheel case inserted between a slant bracket and a print wheel guide plate is lifted by a support member of the slant bracket so that a print wheel shaft can easily enter into a hub hole of a print wheel.

Another object of the present invention is to provide a carriage for an electronic typewriter in which an eccentric stopper for restricting the position of a slant bracket is fixed to a stopper bracket pivotally mounted on a main frame and resiliently supported with a tension spring so that in case that the slant bracket is moved from a front stop position (hereinafter, referred to as a typing position) to a predetermined distance forwardly) hereinafter, referred to as an overshoot) a print wheel shaft mounted on a slant bracket is completely coupled and returned to the typing position by the tension spring, thereby the load and unload of the print wheel is easily carried out.

Another object of the present invention is to provide a carriage for an electronic typewriter in which the print wheel is precisely maintained in a typing position by making the front position of a slant bracket adjustable with an eccentric stopper.

Another object of the present invention is to provide a carriage for an electronic typewriter which is capable of using a moderate solenoid having a simple structure by constructing in such a manner that a hitting force of the solenoid is transferred to a hammer lever and then the hammer lever hits the print wheel.

Another object of the present invention is to provide a carriage for an electronic typewriter in which an up/down and rotational movement of a print wheel is smoothly carried out by coupling a print wheel elevation and rotation mechanism including a drive motor, a pinion, a shifter, a shifter guide, a print wheel gear, a print wheel shaft, a solenoid, and a restriction lever to a slant bracket.

Another object of the present invention is to provide a carriage for an electronic typewriter having a simple structure by commonly using one drive motor and a cam gear to perform the carrying of a print ribbon, the up/down and carrying of a correction tape and the driving of the means for sensing them.

To achieve the above-mentioned objects, the carriage according to the present invention comprises a main frame which moves slidably along rails, a slant bracket which is pivotally mounted on the rails and is forwardly and rearwardly rotated at a predetermined angle upon the pushing and pulling of a knob, a guide plate which is located at the front of the slant bracket and is mounted on the main frame, a vibrator which is coupled at the top of the main frame upwardly and downwardly movably at a predetermined angle, a take-up reel and a supply reel which are, respectively, coupled to a ratchet and a spool pivotally mounted on a side wall plate and around which a correction tape is wound, a print ribbon cartridge coupled to an upper surface of the vibrator, a hammering means using a hammer lever, a print wheel elevation and rotation mechanism in which a print wheel gear fixed to a shaft pivotally mounted to a shaft supporting portion of a shifter is meshed with a pinion of a drive motor and is moved upward and downward while being restricted by a restriction lever operated with a solenoid, a print ribbon carrying mechanism driven by using commonly a drive motor and a cam gear, and a correction tape up/down and carrying mechanism.

BRIEF DESCRIPTION OF THE DRAWINGS

These and other objects, features and advantages of the present invention will become more apparent from the following detailed description taken in conjunction with the accompanying drawings, in which.

DETAILED DESCRIPTION OF THE INVENTION

Figure 1:
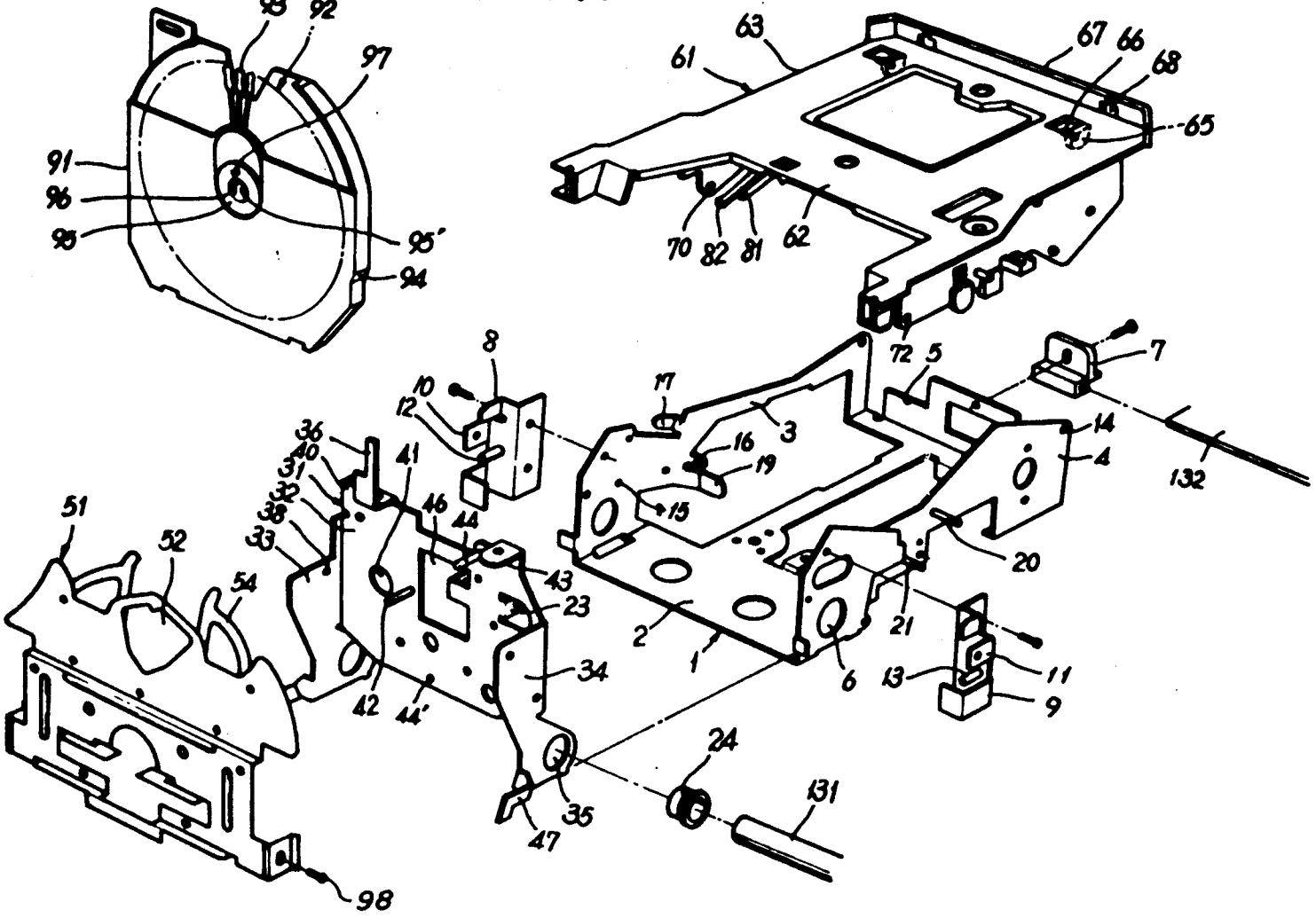
FIG. 1 is an exploded perspective view showing the fundamental structure of a main frame, a slant bracket and a vibrator and the like of a carriage according to the present invention.

Referring to FIG. 1, the carriage of the present invention comprises a main frame 1, a slant bracket 31 and a wheel case guide plate 51 coupled at the front of said main frame 1, and a vibrator 61 coupled at the top of the main frame 1.

The main frame 1 includes side wall plates 3 and 4 and a rear plate 5 formed at both sides and rear side of a base plate 2, respectively, and the slant bracket 31 includes side plates 33 and 34 formed at both sides of a base plate 32.

The side wall plates 33 and 34 of the slant bracket 31 are located within the side wall plates 3 and 4 of the main frame 1, and at the front of the side wall plates 3 and 4 and at the lower ends of the side wall plates 33 and 34 are formed shaft holes 6 and 35 communicating with each other through which a guide bush 24 is inserted and a rod-shaped rail 131 is inserted in the guide bush 24.

In a guide 7 fixed to a rear plate 5 of the main frame 1 is inserted a plate-shaped rail 132, thereby the main frame 1 and slant bracket 31 can be slidably moved along the rails 131 and 132 and the slant bracket 31 can be rotated around the rail 131.

The rails 131 and 132 are mounted in parallel on a carriage mounting portion of a main body of a printer (not shown).

At the front of the main side wall plates 3 and 4 are mounted to wheel case guides 8 and 9 and to each of the fixing members 10 and 11 is fixed a guide plate 51 having a hammer in/out hole 52 by a screw 98 so as to be located at the front of said slant bracket 31. At the mid-portion of the wheel case guides 8 and 9 are fixed support pins 12 and 13, respectively. Between the guide plate 51 and the slant bracket 31 is loaded a wheel case 91 in which a 2-row daisy wheel i.e., a print wheel 92 is inserted.

The vibrator 61 includes side plates 63 and 64 formed at both sides of a base plate 62 thereof and is rotatably mounted on a shaft hole 14 formed at the rear side of the side wall plates 3 and 4 with a pin 66 formed on a support member 65.

Figure 2:
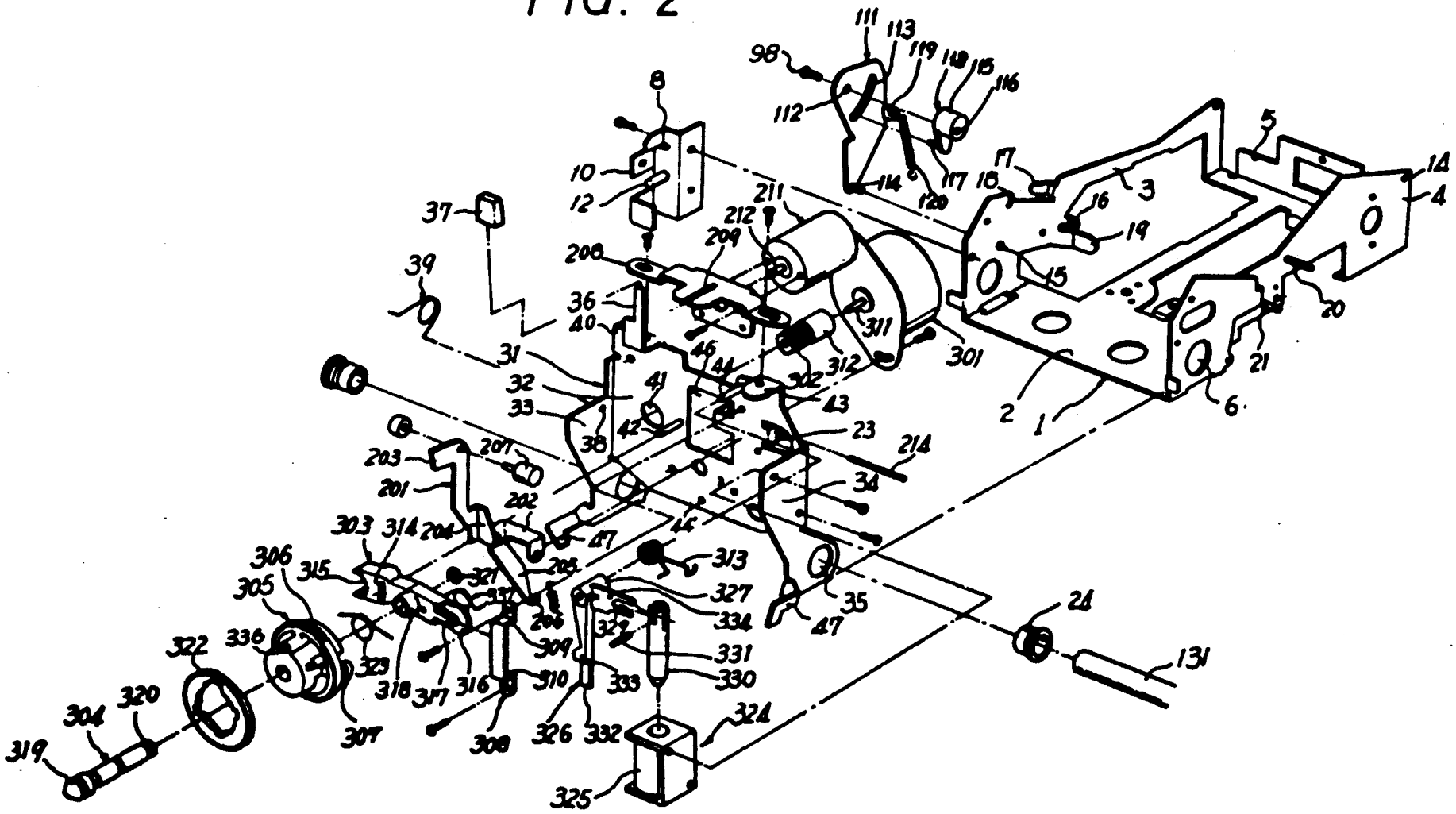
FIG. 2 is an exploded perspective view showing the structure of a print wheel elevation and rotation mechanism and other related parts of the carriage according to the present invention.
Figure 4A:
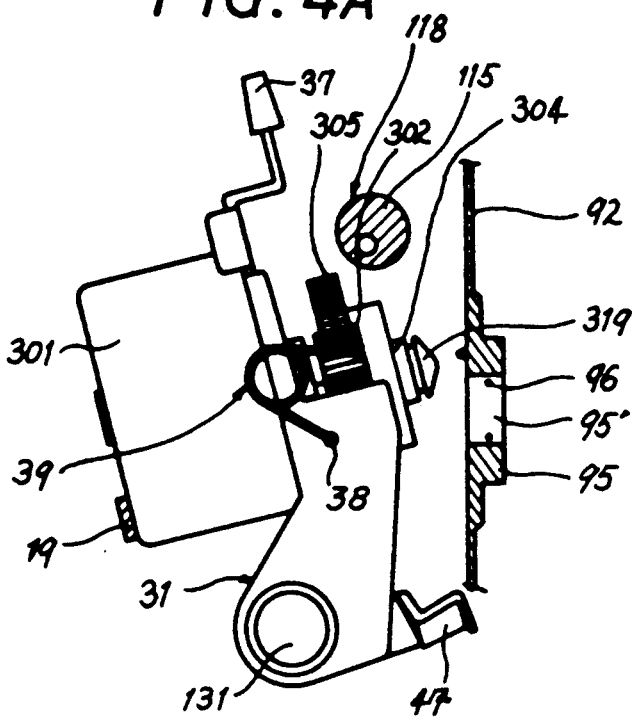
FIGS. 4A and 4B are partial side views showing a print wheel case loading and unloading mechanism of the carriage according to the present invention.
Figure 4B:
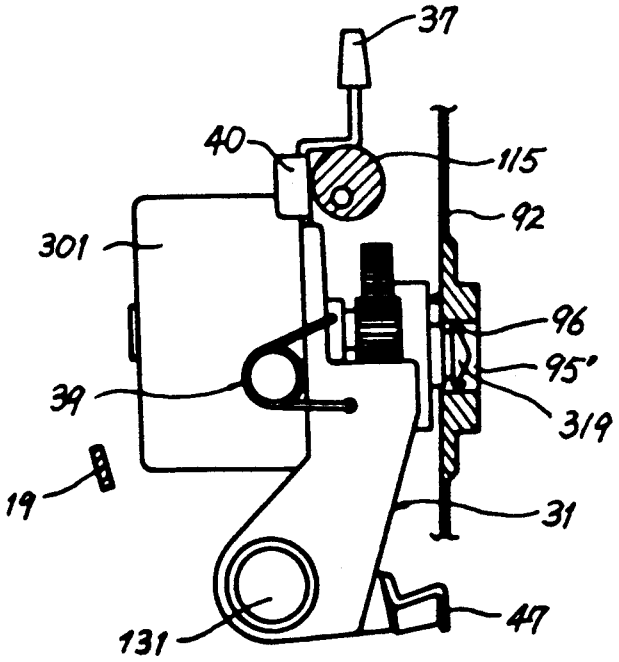

Referring to FIGS. 2 and 4A, and 4B, on a knob fixing member 36 provided upwardly at the slant bracket 31 is fixed a knob 37, and to a fixing hole 38 formed at the mid-portion of one side wall plate 33 and a fixing hole 18 formed on the main side wall plate 3 of the main frame 1 is hung both ends of a toggle spring 39. Consequently, when pulling the knob 37 back, the slant bracket 31 is tilted rearwardly and a housing of a drive motor 301 mounted at the back surface of the slant bracket 31 contacts with a stopper 19 formed on the main side wall plate 3 and becomes stopped, and the contact and stop state is maintained by a resilient force of the toggle spring 39 At this moment, when the knob 37 is pulled front, the slant bracket 31 is tilted forwardly and a contact member 40 of the slant bracket 31 contacts with a cylindrical portion 115 of an eccentric stopper 118 and becomes stopped, and this state is also maintained by a resilient force of the toggle spring 39.

Figure 5A:
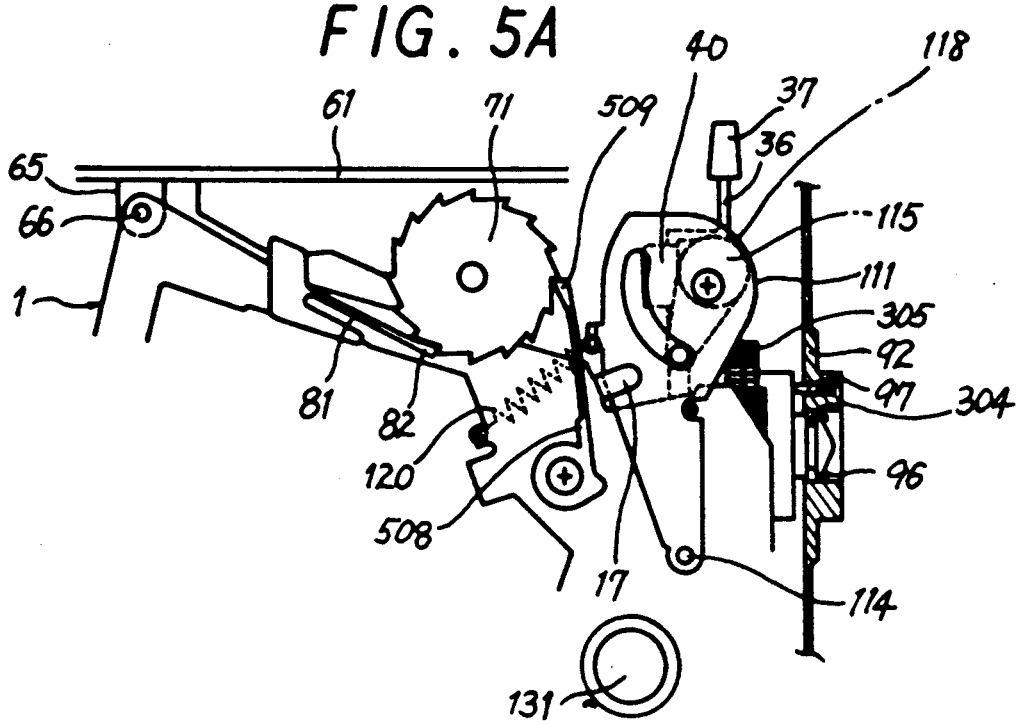
FIGS. 5A and 5B are partial side views showing a loading position adjusting mechanism of a print wheel of the carriage according to the present invention.
Figure 5B:
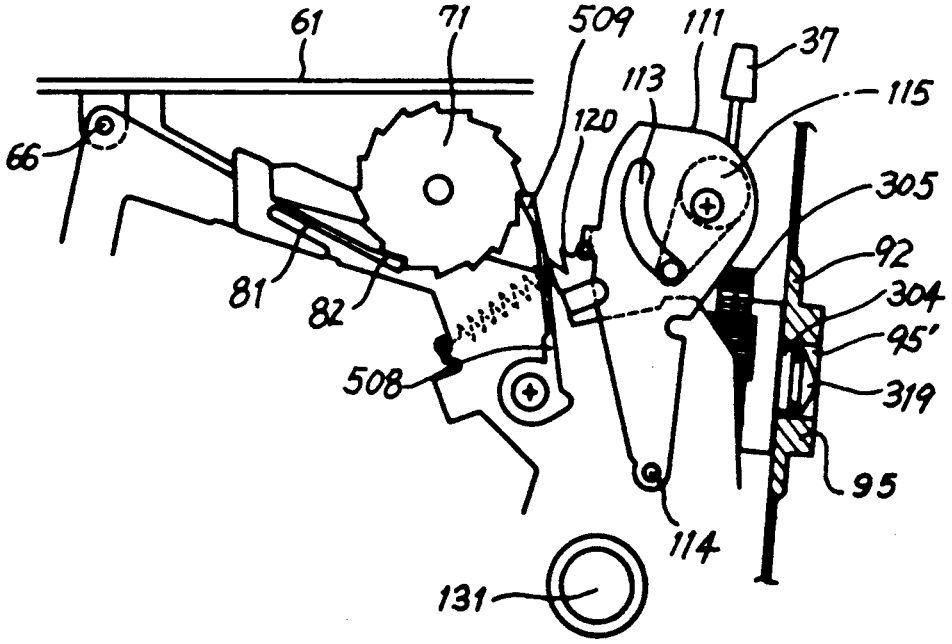

FIGS. 5A and 5B show a print wheel loading position adjusting mechanism, shown in the drawings, in a shaft hole 15 formed at the front of the side wall plate 3 of the main frame 1 is inserted a pin 114 fixed at the lower end of a stopper plate 111 having a fixing hole 112 and an arcuate slot 113 so that the stopper plate 111 can be rotated around the shaft hole 15 (FIG. 2). And a shaft hole 116 is formed eccentrically on a cylindrical portion 115 and an eccentric stopper 118 provided with a handle 117 is coupled to said fixing hole 112 with the screw 98 inserted through the shaft hole 116 and the handle 117 is inserted into the circular adjusting hole 113. Furthermore, between a hook member 119 of the stopper plate 111 and a hook member 16 of the side wall plate 3, a tension spring 120 is connected and on the side wall plate 3 is formed a bent member 17 with which the stopper plate 111 contacts resiliently.

Figure 6A:
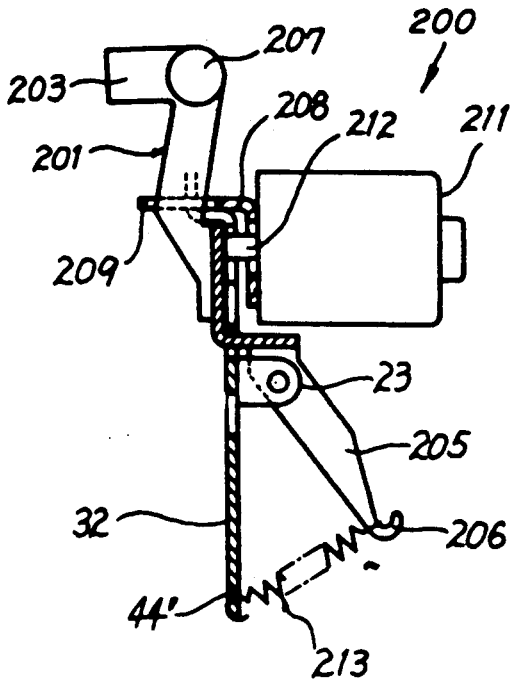
FIGS. 6A and 6B are partial side views showing a hammering mechanism of the carriage according to the present invention.
Figure 6B:
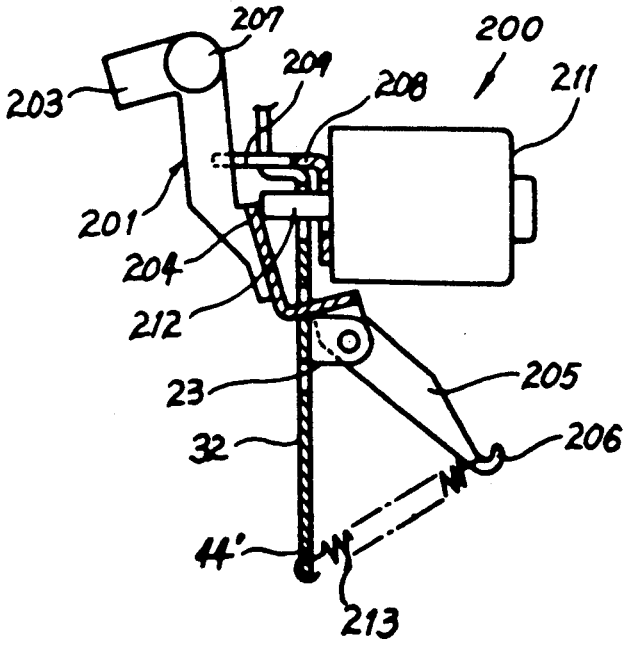

FIGS. 6A and 6B show a hammering mechanism which is adapted to hit a print wheel 92. As shown in the drawings, 200 comprises a hammer lever 201, a solenoid 211 and a tension spring 213.

The hammer lever 201 is provided with a connecting member 202 at the mid-portion thereof and is rotatably mounted on a supporting member 23 projected rearward on the slant bracket 31. And the hammer lever 201 is provided with a hitting portion 203 at the top thereof, and at the mid-portion thereof is provided with a pressing portion 204 over the connecting member 202. On an extension member 205 projected toward the rearward of an opening 46 of the slant bracket 31 is formed a hook member 206 and on a bent member 43 of the slant bracket 31, a hammer guide 208 having a guide groove 209 at the mid-portion thereof is fixed with the screw 98. Between said hook member 206 and a fixing hole 44 formed at the lower portion of the opening 46 of the slant bracket 31, a tension spring 213 is connected so that the hitting portion 203 of the hammer lever 201 contacts with the guide groove 209 of a hammer guide 208 with a pressure.

On a fixing member 210 of the hammer guide 208, a hammer solenoid 211 is fixed so that an operational rod 212 hits the pressing portion 204 of the hammer lever 201 to carry out the typing operation, and a weight 207 is hung on the hitting portion 203 of the hammer lever 201.

Figure 7:
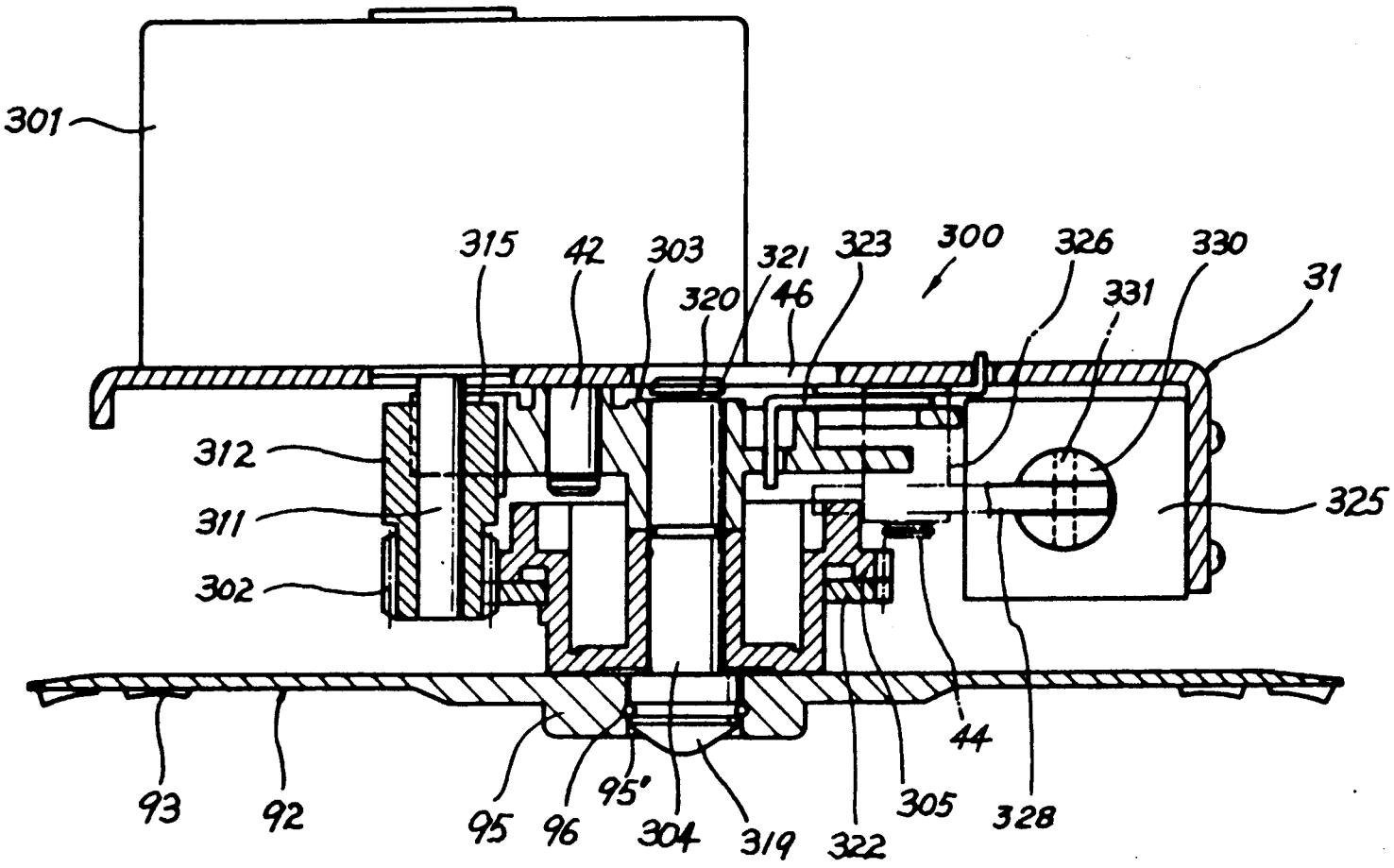
FIG. 7 is a partial sectional side view of the assembled state of FIG. 2.
Figure 8A:
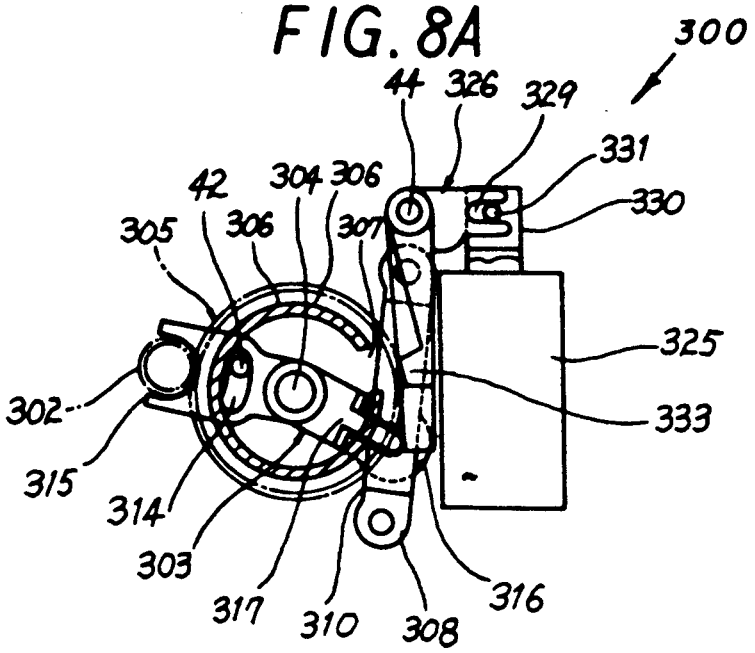
FIGS. 8A and 8B are partial sectional views showing a print wheel up/down and rotation mechanism of the carriage.
Figure 8B:
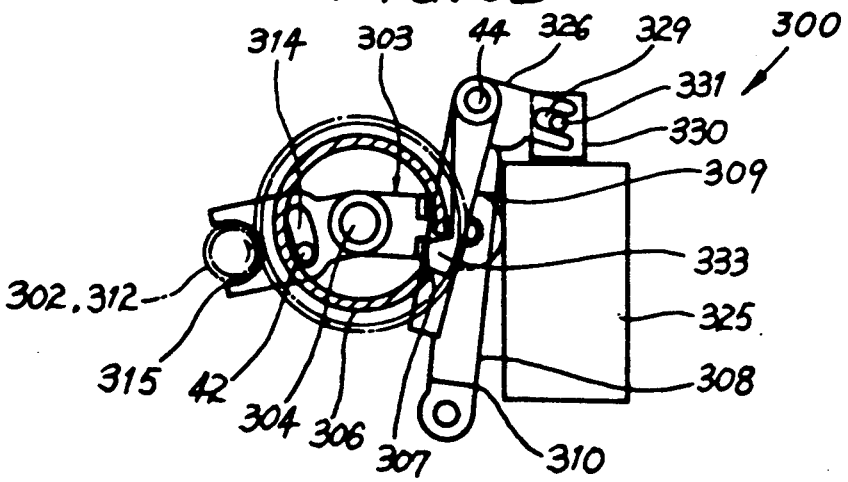

FIGS. 7, 8A, and 8B show a print wheel elevation and rotation mechanism. As shown in the drawings, an elevation and rotation mechanism 300 comprises a drive motor 301, a pinion 302, an elevation shifter 303, a print wheel shaft 304, a print wheel gear 305, a shifter guide 308 and a print wheel rotation stop means 324.

Said drive motor 301 is fixed to a rear surface of the slant bracket 31 with a screw, and on a motor shaft 311 penetrating through a hole 41 is mounted a pinion 302 formed integrally with a cylindrical portion 312 On a pin 42 fixed adjacent to said hole 41, an elevation shifter 303 is inserted into and coupled to an extension hole 314.

The elevation shifter 303 is provided with at one end thereof a U-shaped supporting recess 315 in which the cylindrical portion 312 of said pinion 302 is inserted, at another end thereof a circular guide 316 and a guide member 317 and at the mid-portion thereof a shaft-supporting portion 318 Said extension hole 314 is disposed between the supporting recess 315 and the shaft-supporting portion 318.

The elevation shifter 303 is connected to the slant bracket 31 with a toggle spring 337, and is moved upward or downward around the cylindrical portion 312 of the pinion 302.

In the shaft-supporting portion 318 of the elevation shifter 303, a print wheel shaft 304 having a cone-shaped projection 319 is rotatably inserted. On a hooking recess 320 of the print wheel shaft 304 projected toward the rear through the shaft-supporting portion a washer 321 is fixed and at the front thereof a print wheel gear 305 is fixed, and at the front of the print wheel gear 305 an auxiliary gear 322 is coupled through the intermediary of a torsion spring 323 so as to be received a resilient force in the peripheral direction. The two gears 305 and 322 are meshed closely with the pinion 302.

In addition, on a predetermined portion of the slant bracket 31 is fixed a shifter guide 308 having upper and lower hook members 309 and 310 so as to be inserted between the circular guide 316 of the elevation shifter 303 and the guide member 317.

The rotation stop means 324 is adapted to stop the print wheel gear 305 in a predetermined position, and is comprised of a solenoid 325 fixed to the slant bracket 31 and a restriction lever 326 interconnected with and rotated by the solenoid 325.

The restriction lever 326 is rotatably mounted on the shaft-supporting portion 327 with a pin 44 of the slant bracket 31 inserted therein, the U-shaped recess 329 formed on the connecting member 328 of the restriction lever 326 is connected to a plunger 330 of the solenoid 325 with a connecting pin 331, and on an operational bar 332 formed across to said connecting member 328 is formed a restriction projection 333. On a spring hole 334 of the connecting member 328 is fixed one end of a torsion spring 313 and at the opening 46 of the slant bracket 31 (FIG. 2) is fixed another end of the torsion spring 313 with the body thereof inserted in the exterior of the shaft-supporting portion 327. The restriction lever 326 is resiliently supported in an anticlockwise direction by the torsion spring 313 In addition, the print wheel gear 305 is provided integrally with a cylindrical portion 306 at the rearward thereof and on the peripheral surface of the cylindrical portion 306 is provided an initial position determining groove 307.

When the solenoid 325 is operated and then the plunger 330 is pulled downward, the restriction lever 326 overcomes the resilient force of the torsion spring 313 and turns around the pin 44, and the restriction projection 333 of the wheel gear 305 is inserted into the initial position determining groove 307 of the print wheel gear 305. Therefore, the print wheel gear 305 becomes not to rotated.

Referring to FIG. 3 and FIG. 9A to FIG. 11, as shown in the drawings, at the shaft holes 70 and 72 formed on the side wall plates 63 and 64 of the vibrator 61 are pivotally mounted a correction tape ratchet 71 and a correction tape spool 73. To the spool 73 and ratchet 71 are coupled a correction tape supply reel 75 and a correction tape take-up real 76 so that when the ratchet 71 is rotated the take-up reel 76 coupled therewith winds up the correction tape 78 while rotating and from the supply reel 75 rotated with said spool 73 the correction tape 78 is drawn out.

On the side wall plate 64 of the vibrator 61 is fixed a spool stopper 79 whose front end 80 is inserted into a gear portion 74 of a spool 73, thereby preventing the spool 73 from rotating voluntarily and on another side wall plate 63 is formed integrally a ratchet stopper 81, thereby preventing it from rotating in the reverse direction by hanging the front end 82 thereof on the ratchet 71.

In addition, on the take-up reel 76, a handle 77 is integrally formed for conveying the correction tape 78 in a mannual operation. At the top of the vibrator 61, a ribbon cartridge 101 is loaded.

The ribbon cartridge 101 is provided at the rearward thereof with projections 103 which are inserted into rectangular holes 68 formed at both sides of a vertical plate 67 of the vibrator 61, and a lock hole 104 formed at the front of the ribbon cartridge 101 is hung on a lock spring 69 fixed to the front of the vibrator 61 so that the loaded ribbon cartridge 101 is safely maintained At one side of the ribbon cartridge 101 is pivotably mounted a print ribbon take-up reel 105 having a handle at the top thereof.

At the predetermined portion of the vibrator 61, a print ribbon winder 83 meshed with the lower end of the take-up reel 105 of the ribbon cartridge 101 is rotatably mounted, and on a triangular elastic hanger 85 formed at the lower portion of a shaft 84 of the winder 83, a ratchet 87 is hung through a central rectangular hole 88. At the lower portion of the elastic hanger 85 is formed a hooking projection 86 for preventing the ratchet 87 from separating.

The winder 83 and the ratchet 87 are rotated together in one body. On the side wall plate 64 of the vibrator 61 is fixed a stopper 89 for preventing the ratchet 87 rotating in one direction.

Figure 3:
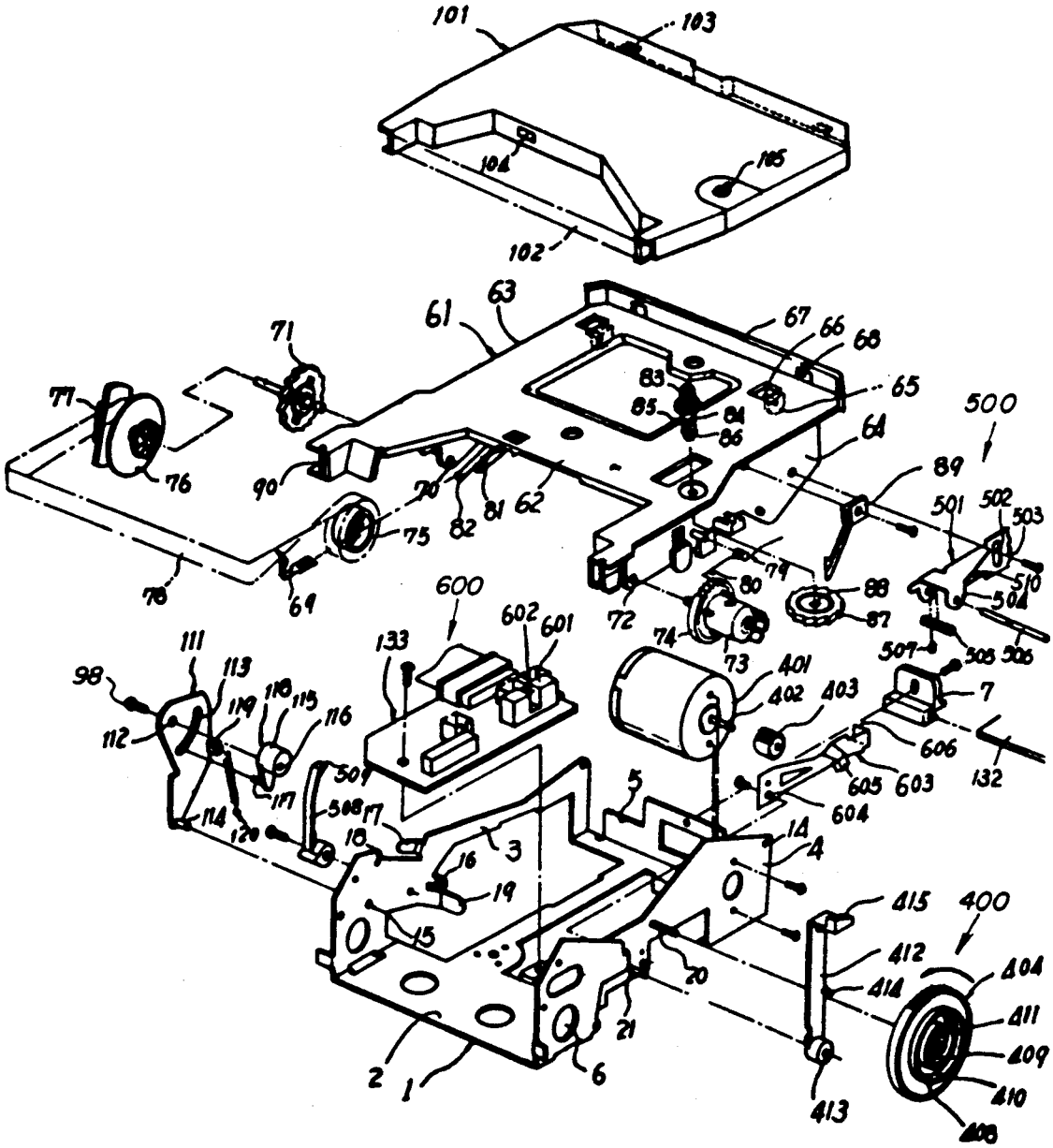
FIG. 3 is an exploded perspective view showing the structure of a print ribbon and correction tape drive mechanism, a sensing means and other parts of the carriage according to the present invention.
Figure 9A:
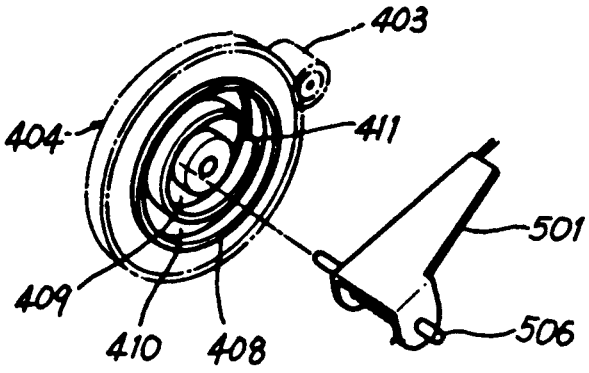
FIGS. 9A, 9B, 10A and 10B are explanatory views of a print ribbon carrying mechanism and a correction tape carrying mechanism of the carriage.
Figure 9B:
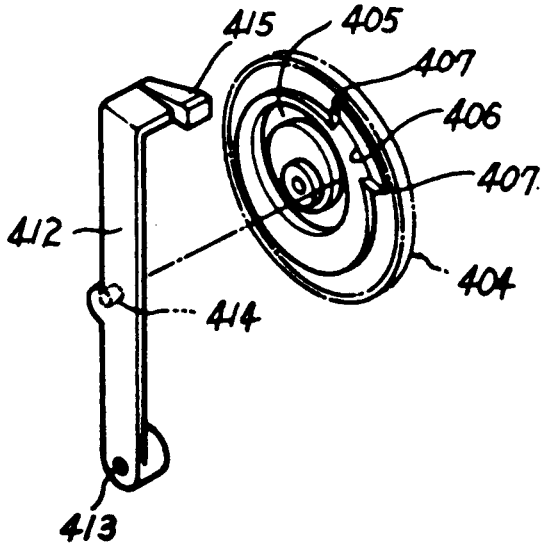

The print ribbon 102 disposed in the ribbon cartridge 101 is automatically carried by a print ribbon carrying mechanism 400 and the correction tape 78 is automatically carried by a correction tape up/down and carrying mechanism 500 as follows (FIGS. 3, 9A, and 9B).

The print ribbon 102 carrying mechanism 400 comprises a drive motor 401 fixed to a inner surface of the side wall plate 4 of the main frame 1, a cam gear 404 pivotally mounted on a pin 20 of an outer surface of the side wall plate 4 so as to be meshed with a pinion 403 fixed to a motor shaft 402, and a cam lever 412 pivotally mounted on a pin 21 through a shaft hole 413 at its one end and interconnected with the cam gear 404.

The cam gear 404 is provided with a cam groove 405 disposed in the inner surface thereof for receiving an operational pin 414, as shown in FIGS. 3, 9A, 9B, 10A, and 10B, and at the top of the cam lever 412 is provided with a drive projection 415 meshed with the ratchet 87.

When the cam gear 404 is rotated by the driving force of the drive motor 401, the cam lever 412 is reciprocally rotated around the pin 21 within the predetermined range of angle to make to rotate the ratchet 87 and then when the ratchet 87 is rotated the printer ribbon winder 83, the ribbon take-up reel 105 of the ribbon cartridge 101 meshed therewith is rotated together and thus the print ribbon 102 is fed.

The correction tape up/down and carrying mechanism 500 comprises, as shown in FIGS. 3 and 9A, a cam bracket 501 fixed to the side wall plate 64 of the vibrator 61, a cam pin 506 resiliently connected to the cam bracket 501 by a coil spring 505, and an operational member 508 fixed to the side wall plate 3 and provided with a drive pully 509 meshed with the ratchet 71, and commonly utilizes the cam gear 404 and the drive motor 401.

The cam bracket 501 is provided with at one side thereof an extension hole 502 and a position adjusting groove 503 and at the other side thereof a fixing hole 510 and a supporting member 504, respectively. In the supporting member 504, said cam pin 506 is inserted and supported and between a washer 507 fixed at the mid-portion of the cam pin 506 and the supporting member 504 is inserted a pressing spring 505 which is adapted to resiliently push the cam pin 506 inwardly so that the cam pin 506 contacts resiliently with a cam groove 408 formed at the outer surface of the cam gear 404. The cam pin 506 is easily separated by pulling the outer end from the cam groove 408 when separating the vibrator 61 from the main frame 1.

Figure 11:
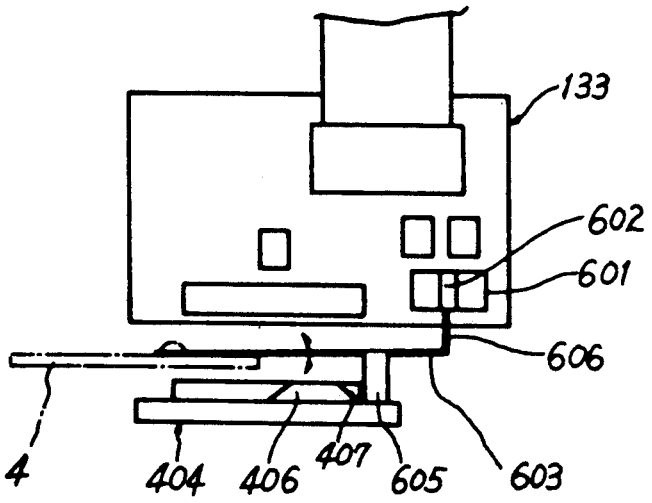
FIG. 11 is a plan view showing a carrying sensor portion of the carriage.

And, the rotation of the cam gear 404 is detected by a sensing means 600 including a sensor 601 such as a photosensor having a light-emitter and a light-receiver, and a sensing lever 603 made of a leaf spring (FIGS. 3 and 11). The sensing means 600 commonly utilizes said cam gear 404.

The sensor 601 is, as shown in FIGS. 3 and 11, mounted on a circuit board 133 fixed to the base plate 2 of the main frame 1, the sensing lever 603 is provided with at one end thereof a fixing hole 604, at the mid-portion thereof a contacting member 605 and at the other end thereof a cutoff member 606 opposite to the contact member 605 The sensing lever 603 is fixed on a inner surface of the side wall plate 4 of the main frame 1 with the screw 98 inserted into the fixing hole 604 and the contact member 605 contacts with a projection 406 formed around the cam groove 405. Said projection 406 is provided with slant surfaces 407 at both sides thereof, as shown in FIG. 9B.

When the contact member 605 of the sensing lever 603 is moved with the cam gear 404 upon the rotation of the drive motor 401, the cutoff member 606 of the sensing lever 603 is either inserted into the sensor 601 or separated therefrom and the sensor 601 becomes to detect it.

The print wheel case 91 (FIG. 1) is provided with at both side walls thereof a hook step 94 which is hung and supported by supporting members 12 and 13 and on the inner surface of a central hole 95' of a hub 95 of a print wheel 92 contained in the print wheel case 91 is fixed a retaining spring 96 for retaining the print wheel 92 within the projection 319 of the print wheel shaft 304. In a fixing hole formed at a predetermined portion of the hub 95, a position determining pin 97 with a pressing spring are inserted (FIG. 5A).

In FIG. 1, the reference numeral 47 is a supporting pin which is formed at the slant bracket 31 and is adapted to support the print wheel case 91 represents a ribbon guide fixed to the top of the guide plate 51, and 90 represents a correction tape guide roll (FIG. 3).

The carriage member for an electronic typewriter of the present invention is movably mounted on the rails 131 and 132 parallel to a platen (not shown).

In the drawings, though the majority of the operations are carried out automatically, the related circuit diagram and control part for the operations are ommitted for convenience.

In such an arrangement, the print wheel 92 and print wheel case 91 loading operation, the position adjusting operation of the print wheel 92, the elevation operation, the typing operation, the ribbon carrying operation, and the correction tape carrying operation will now be described in the order of the steps.

When the print wheel case 91 containing the print wheel 92 is inserted between the guide plate 51 and the slant bracket 31 as shown in FIG. 4A, the print wheel case 91 is hung and supported by the supporting member 47 of the slant bracket 31. At this moment the knob 37 is pushed forward as shown in FIG. 4B and FIG. 5A, the slant bracket 31 is rotated forward around the rail 131 and the print wheel shaft 304 is also rotated forward so that the cone-shaped end 319 is slightly inserted into the central hole 95' of the hub 95 formed at the print wheel 92. At this moment, in order to completely load, the print wheel shaft 304 is pushed toward the forward of the printer wheel shaft 304 as shown in FIG. 5B and the knob 37 is pushed toward the forward too, and thus the slant bracket 31 is tilted forward a little by overshooting, the cylindrical portion 115 of the eccentric stopper 118 is pushed by the contact projection 40 and the stopper plate 111 is rotated forward around the axial pin 114. By such an overshoot movement, the cone-shaped end 319 of the shaft 304 is completely coupled with the central hole 95' of the print wheel 92. Under such a state that the print wheel 92 is coupled to the shaft 304, when a user's hand is taken off from the knob 37, the stopper plate 111 is rotated rearward around the axial pin 114 by the resilient force of the tension spring 120 and then contacts with the bent member 17 and becomes stopped. At this moment, the slant bracket 31 is rotated rearward with its contact member 40 contacted with the cylindrical portion 115 of the eccentric stopper 118 by the force of the toggle spring 39, to return to the position as shown in FIGS. 4B and 5A, thereby the print wheel 92 reaches the correct typing position and is maintained safely in that position At this moment, the jaw 94 of the print wheel case 91 is hung on the supporting members 13 and 14 of the wheel case guides 8 and 9, and the position of the printer wheel 92 can be adjusted more or less by moving the eccentric stopper 118 upward and downward the adjusting hole 113 by use of the handle 117.

Thereafter, it is intended to pull out the print wheel case 91, the knob 37 is pulled rearward as shown in FIG. 4A to rotate the slant bracket 31 rearward around the rail 131 so that the shaft 304 is pulled out of the hub hole 95' of the print wheel 92, and at the same time the lower supporting member 47 of the slant bracket 31 presses upward the lower portion of the print wheel case 91 so as to be easily grasped and pulled out by a user. At this moment, a housing of the drive motor 301 is contacted with a stop member 19 of the main frame 1 by the toggle spring 39.

Such a print wheel loading and unloading mechanism 30 provides the advantages that the loading and unloading operation of the print wheel 92 is easily and conveniently carried out by use of the knob 37 and not only the loading position of the print wheel 92 is precisely and safely maintained, but also the loading position is adjusted by use of the eccentric stopper 118.

Under the state that the print wheel 92 is loaded, when the print wheel drive motor 301 rotates, the pinion 302 and the print wheel gear 305 meshed therewith are rotated as shown in FIGS. 7, 8A, and 8B and thus the position determining pin 97 of the print wheel 92 is inserted into an inserting groove 336 of the print wheel gear 305, whereby the reference position of the print wheel 2 is maintained.

Thereafter, the solenoid 325 becomes actuated and its plunger 330 moves downward as shown in FIGS. 8A and 8B, and the restriction lever 326 rotates in the clockwise direction and the restriction projection 333 advances forward. Under such a state, the drive motor 301 is operated to rotate the pinion 302 and the shaft 304 meshed therewith, and the print wheel gear 305 is rotated in the clockwise or anticlockwise direction so that the restriction projection 333 is inserted into an initial position determining groove 307 formed on the cylindrical portion 306, thereby the print wheel gear 305 is restricted and stopped. Consequently, the elevation shifter 303 moves upward or downward around the cylindrical portion 312 of the pinion 302 and at this moment, the toggle spring 337 pushes upward and downward the circular guide 316 of the shifter 303 until the circular guide 316 contacts with upper and lower hooking steps 309 and 310 of the shifter guide 308, thereby the upper and lower position of the shifter 303 is determined. Consequently, the print wheel 92 fixed to the shaft 304 also moves upward and downward as much as required by the upper and lower typing rows.

After the initial position of the print wheel 92 is determined and the up/down movement is completed, when the power supplied to the solenoid 325 is cutoff, the restriction lever 326 is rotated in the anticlockwise direction by the resilient force of the torsion spring 313 to separate the restriction projection 333 from the initial position determining groove 307 of the print wheel gear 305. And the drive motor 301 rotates in a predetermined angle upon the signal from a control unit according to letter elements to be typed, and the print wheel gear 305 is rotated in the clockwise or anticlockwise direction to rotate the print wheel 92 coupled to the print wheel shaft 304, whereby the selected letter element corresponds to the typing position which is the hitting position of a hammer 203.

Such a print wheel elevation and rotation mechanism 300 is possible not only to carry out the up/down and rotation movement at the same time by the driving force of the drive motor 301, also to carry out smoothly the up/down movement with a simple construction using a solenoid 325, a shifter 303 and a restriction lever 306. And, in particular, since the print wheel gear 305 is always capable of returning to the initial position by the initial position determining groove 307 and the restriction projection 333 of the restriction lever 326, the initial position determining means becomes very simplified.

After moving upward and downward and rotating, the print wheel 92 is stopped and the letter element selected as above is coincident with the typing position, the hammer solenoid 211 is actuated so that the operational rod 212 hits the pressing portion 204 of the hammer lever 201, thereby the hitting portion 203 of the hammer lever 201 hits the spoke 93 of the print wheel 92 to type. After typing, the power turns off and the above parts return to original state by the tension spring 213 so as to get ready for the next operation.

Since the existing solenoid is 211 utilized for the hammering by use of the hammer lever 201, the reduction in cost is achieved.

Figure 10A:
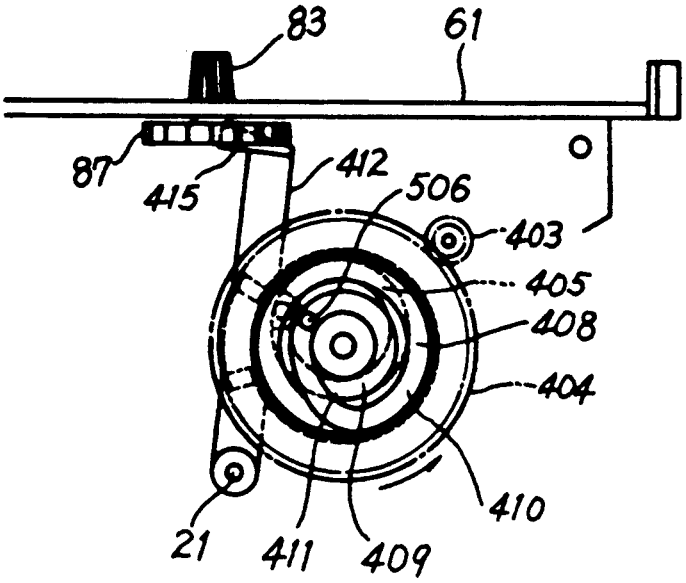
Figure 10B:
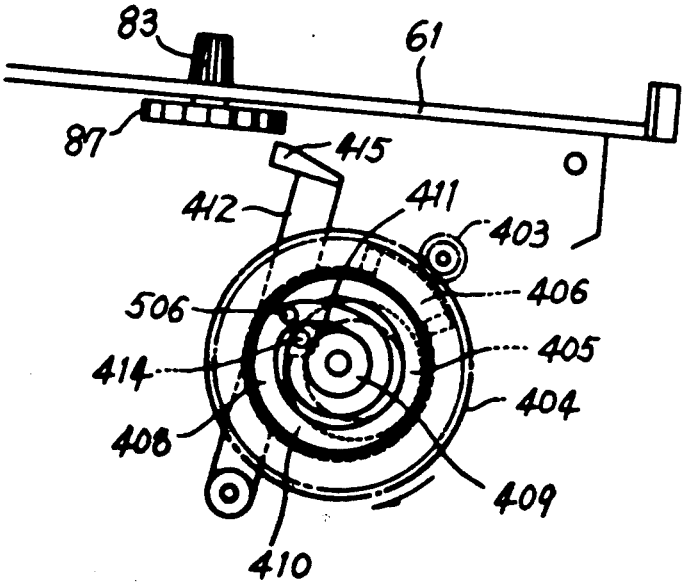

In the course of accomplishing the typing operation, the drive motor 401 is actuated as shown in FIGS. 9A to 11, the cam gear 404 rotates in the anticlockwise direction on the basis of FIG. 10A and the cam lever 412 interconnected with the inner cam groove 405 of the cam gear 404 rotates reciprocally around the pin 21 in a predetermined angle so that a drive projection 415 provided at the top of the cam lever 412 rotates the ratchet 87 pivotally mounted to the vibrator 61 by one pitch and the print ribbon winder 83 and take-up reel 105 of the ribbon cartridge 101 are rotated together, thereby the print ribbon 102 becomes to be fed by one letter at every typing operation.

On the other hand, when a mistyping occurs during the typing operation, the drive motor 401 is rotated reversely to rotate the cam gear 404 in the clockwise direction and a cam pin 506 of the cam bracket 510 inserted in the outer cam groove 408 of the cam gear 404 moves upward from a small-diameter portion 409 to a large-diameter portion 410 along the jaw-guide portion 411 and the vibrator 61 moves upward together with the cam bracket 501 so that the correction tape 78 reaches the typing position and moves to the letter by means of the operational rod 508 and ratchet 71. Under such a state, the hammering is carried out to remove the mistyping.

After the correction is completed, the cam gear 404 is rotated in the anticlockwise direction by the driving force of the drive motor and the cam pin 506 moved from the large-diameter portion 409 along the cam groove 408, 410 to the small-diameter portion and in case that the cam gear 404 rotates continuously in the anticlockwise direction and the print ribbon 102 becomes to be fed.

The sensing lever 603 which contacts with the projection 406 formed at the inner surface of the cam gear 404 by a contact member 605 detects the carrying of the print ribbon 102 and correction tape 78 by transmitting the signals to a control unit when the cutoff member 606 is inserted into an inserting hole 602 one time at the time of one rotation of the cam gear 404 and at this moment the sensor 601 detects the insertion of the cutoff member 606.

The print ribbon carrying mechanism, correction tape up/down and carrying mechanism, and sensing mechanism are operatively utilized the drive motor 401 and cam gear 404 so that the whole construction can be simplified.

As described above in detail, the carriage for an electronic typewriter according to the present invention is advantageous in that it is possible not only to load and unload the print wheel by a simple manipulation of rotating the slant bracket by use of a knob, but to maintain safely the slant bracket in a forward and backward movement and also to easily carry out the overshoot and position adjusting function of the print wheel by adopting the stopper plate and eccentric stopper.

Furthermore, it is possible to carry out the up/down and rotation movement of the print wheel without using an additional drive unit by the marginal movement of the print wheel drive motor by means of the function of shifter, shifter guide, restriction lever and solenoid.

Furthermore, it is possible not only to utilize a simple and moderate solenoid for hammering by use of the hammer lever, but to carry out the up/down and carrying operation of the ribbon tape and correction tape with a simple-structured mechanism commonly using one drive motor and a cam gear.

Therefore, the present invention provides a carriage of a simple structure, a low cost and a high reliability compared to the conventional one in the electronic typewriter using a 2-row daisy wheel.

What is claimed is:

1. A carriage device for an electronic typewriter comprising:

a slant bracket rotatably mounted on a forward end of a main frame around a rail for pushing and rotating a knob;

a toggle spring having one end connected to one side wall plate of said main frame and the other end thereof connected to one side wall plate of said slant bracket, said toggle spring resiliently supporting the slant bracket in forward and rearward position;

an eccentric stopper and a stop member mounted on the side wall plate of the main frame, respectively, for restricting the forward and rearward rotation of said slant bracket;

a print wheel loading means including a pair of supporting members formed at both lower ends of said slant bracket and structured in a manner such that when a print wheel case is inserted at the position where the slant bracket is retracted, the upper end thereof is supported by the supporting member of the slant bracket so that a print wheel shaft is smoothly entered into a central hole of a hub of a print wheel;

a hammering means including a solenoid fixed to a hammer guide of the slant bracket so that an operational rod hits a hammer lever, whereby a spoke of the print wheel is hit by the hammer lever so as to be typed;

a print wheel elevation and rotation member for moving upward and downward and rotating the print wheel to a typing position;

a print ribbon carrying member for carrying a print ribbon;

a correction tape up/down and carrying member for moving upward and downward and carrying a correction tape;

a first drive motor for driving the print ribbon carrying member and correction tape up/down and carrying member; and a sensing means interconnected with a cam gear for detecting the carrying condition of the correction tape and print ribbon by sensing the rotation of the cam gear.

2. The carriage device as claimed in claim 1, wherein the print wheel loading means further comprises:

a stopper plate pivotally mounted on the side wall plate of the slant bracket with a pin and to which the eccentric stopper is fixed;

a bent member formed on the side wall plate of the slant bracket and contacting the stopper plate at the retreated position thereof; and a tension spring resiliently contacting with the stopper plate with the bent member, whereby when the slant bracket overshoots at the position where the slant bracket is restricted to the eccentric stopper with a contact projection, jaw members of the print wheel case are hung and supported by support pins of wheel case guides, and the print wheel shaft is completely engaged with the central hole of the hub and returns a typing position by the resilient force of the tension spring.

3. The carriage device as claimed in claim 2, wherein said eccentric stopper is provided with a cylindrical portion thereof an eccentric shaft hole and is coupled to a fixing hole of the stopper plate with a screw inserted into the eccentric shaft hole, a handle formed at the cylindrical portion thereof is inserted into an arcuate adjusting slot centering around the fixing hole of the stopper plate, and upon the rotation of the eccentric stopper with the handle the typing position of the slant bracket and print wheel is adjusted.

4. The carriage device as claimed in claim 1, wherein said hammer lever is provided with at the top thereof a weight, at the mid-portion thereof a connecting member connected to a supporting member of the slant bracket with a hinge pin, a pressing portion formed at one side of the connecting member on which the operational rod of the solenoid hits, at the top thereof a hitting portion, at the lower end of an extension member a hook member, and a tension spring disposed between the hook member and a lower fixing hole of the slant bracket.

5. The carriage device as claimed in claim 1, wherein said print wheel elevation and rotation member further comprises:

a second drive motor fixed to a back surface of the slant bracket;

a second pinion integrally formed with a cylindrical portion and fixed to a shaft of said second drive motor;

an elevation shifter provided with at one end thereof a supporting groove in which said cylindrical portion is inserted, at the other end thereof a circular guide and a guide member, at the mid-portion thereof a shaft-supporting portion, and an extension hole in which a pin of the slant bracket is inserted;

a toggle spring for resiliently connecting with the shifter to the slant bracket;

a shifter guide fixed to a base plate of the slant bracket for guiding the rotation of the shifter and to restrict the up/down position of the shifter;

a print wheel shaft pivotally mounted to the shaft supporting portion of the shifter and provided with a cone-shaped end;

a print wheel gear and an auxiliary gear, each of said gears being fixed to the print wheel shaft and meshed with the pinion;

a torsion spring inserted between the print wheel gear and the auxiliary gear for resiliently supporting and making said print wheel and auxiliary gears to be meshed closely with the second pinion;

a restriction lever including a restriction projection pivotally mounted to the pin of the slant bracket and inserted into an initial position determining groove of the print wheel gear;

a torsion spring for resiliently connecting with the restriction lever to the base plate of the slant bracket; and a solenoid having a plunger, said plunger connected to the restriction lever.

6. The carriage device as claimed in claim 1, wherein said print ribbon carrying member further comprises:

a first pinion fixed to a shaft of said first drive motor; said cam gear meshed with said first pinion;

a cam lever interconnected to a cam groove with a pin;

a ratchet rotated by a drive projection of said cam lever for rotating a print ribbon winder; and a stopper for restricting onedirectional rotation of said ratchet, whereby the print ribbon moves the letter at the time of typing one letter by rotating a take-up reel of a ribbon cartridge detachably coupled to a base plate of a vibrator.

7. The carriage device as claimed in claim 1, wherein said correction tape up/down and carrying member further comprises a cam pin inserted in an outer cam groove, a cam bracket fixed to a vibrator and to which said cam pin is fixed through the intermediary of a washer and a spring, a ratchet and a spool for carrying the correction tape pivotally mounted on both side wall plates of the vibrator, respectively, stoppers for restricting one-directional rotation of said ratchet and spool, and an operational rod for rotating the ratchet.

8. The carriage device as claimed in claim 1, wherein an outer cam groove of said cam gear comprises a small-diameter portion and a large-diameter portion both of which are formed concentrically, and a jaw-guide portion formed therebetween.

9. The carriage device as claimed in claim 1, wherein said cam gear rotation sensing means further comprises a sensor mounted on a circuit board fixed to a base plate of said main frame, a projecting portion formed around a inner cam groove of the cam gear and provided with at both ends thereof slant surfaces, and a sensing lever fixed to the main frame and provided with a contact member disposed at the mid-portion thereof for contacting with said projection portion and a cutoff member disposed at one end thereof and inserted into a recess of the sensor.

* * * * *